US009956137B2

(12) United States Patent
Borsutzki et al.

(10) Patent No.: US 9,956,137 B2
(45) Date of Patent: May 1, 2018

(54) ACCESS ASSEMBLY WITH A PIERCEABLE SEALING MEMBER

(71) Applicant: Sanofi-Aventis Deutschland GmbH, Frankfurt am Main (DE)

(72) Inventors: Falk Borsutzki, Frankfurt am Main (DE); Manfred Weber, Frankfurt am Main (DE); Ulrich Bruggemann Fricke, Selters (DE)

(73) Assignee: Sanofi-Aventis Deutschland GmbH, Frankfurt am Main (DE)

( * ) Notice: Subject to any disclaimer, the term of this patent is extended or adjusted under 35 U.S.C. 154(b) by 0 days. days.

(21) Appl. No.: 14/761,806

(22) PCT Filed: Jan. 20, 2014

(86) PCT No.: PCT/EP2014/050972
§ 371 (c)(1),
(2) Date: Jul. 17, 2015

(87) PCT Pub. No.: WO2014/114574
PCT Pub. Date: Jul. 31, 2014

(65) Prior Publication Data

US 2015/0359707 A1 Dec. 17, 2015

(30) Foreign Application Priority Data

Jan. 22, 2013 (EP) ..... 13152151

(51) Int. Cl.
*A61J 1/14* (2006.01)
*B67D 3/04* (2006.01)
(Continued)

(52) U.S. Cl.
CPC ..... *A61J 1/14* (2013.01); *A61J 1/1475* (2013.01); *A61J 1/1406* (2013.01)

(58) Field of Classification Search
CPC ..... A61J 1/14; A61J 1/1475; A61J 1/1406; B67D 3/043; B67B 7/26
See application file for complete search history.

(56) References Cited

U.S. PATENT DOCUMENTS 533,575 A 2/1895 Wilkens
4,524,880 A 6/1985 Danielson et al.
(Continued)

FOREIGN PATENT DOCUMENTS

CN 201727738 U 2/2011
CN 202397817 U 8/2012
(Continued)

OTHER PUBLICATIONS

English Translation of Abstract of Chinese Patent Application No. 201727738 dated Jul. 13, 2017.
(Continued)

*Primary Examiner* — Andrew T Kirsch
(74) *Attorney, Agent, or Firm* — McDonnell Boehnen Hulbert & Berghoff LLP

(57) ABSTRACT

The present invention relates to an access assembly to provide access to the interior of a vessel and comprising: a base to extend through a sidewall of the vessel and having a tubular sealing portion providing a passageway axially extending therethrough, a pierceable sealing member arranged across the sealing portion to obstruct the passageway, at least one closure member axially displaceable relative to the base between a sealing position, in which the closure member completely obstructs and seals the passageway, and a leakage position, in which the closure member leakily obstructs the passageway.

14 Claims, 6 Drawing Sheets

(51) Int. Cl.
*B67D 7/26* (2010.01)
*B65D 53/00* (2006.01)

(56) References Cited

U.S. PATENT DOCUMENTS

| | | | | |
|---|---|---|---|---|
| 5,226,895 | A | | 7/1993 | Harris |
| 5,279,586 | A | | 1/1994 | Balkwill |
| 5,304,152 | A | | 4/1994 | Sams |
| 5,320,609 | A | | 6/1994 | Haber et al. |
| 5,351,860 | A | * | 10/1994 | Gotoh ..... B67D 3/043 222/82 |
| 5,383,865 | A | | 1/1995 | Michel |
| 5,480,387 | A | | 1/1996 | Gabriel et al. |
| 5,505,704 | A | | 4/1996 | Pawelka et al. |
| 5,582,598 | A | | 12/1996 | Chanoch |
| 5,626,566 | A | | 5/1997 | Petersen et al. |
| 5,674,204 | A | | 10/1997 | Chanoch |
| 5,688,251 | A | | 11/1997 | Chanoch |
| 5,921,966 | A | | 7/1999 | Bendek et al. |
| 5,961,495 | A | | 10/1999 | Walters et al. |
| 6,004,297 | A | | 12/1999 | Steenfeldt-Jensen et al. |
| 6,193,698 | B1 | | 2/2001 | Kirchhofer et al. |
| 6,221,046 | B1 | | 4/2001 | Burroughs et al. |
| 6,235,004 | B1 | | 5/2001 | Steenfeldt-Jensen et al. |
| 6,248,095 | B1 | | 6/2001 | Giambattista et al. |
| 6,899,698 | B2 | | 5/2005 | Sams |
| 6,936,032 | B1 | | 8/2005 | Bush, Jr. et al. |
| 7,241,278 | B2 | | 7/2007 | Moller |
| 2002/0052578 | A1 | | 5/2002 | Moller |
| 2002/0120235 | A1 | | 8/2002 | Enggaard |
| 2003/0050609 | A1 | | 3/2003 | Sams |
| 2004/0059299 | A1 | | 3/2004 | Moller |
| 2004/0210199 | A1 | | 10/2004 | Atterbury et al. |
| 2004/0267207 | A1 | | 12/2004 | Veasey et al. |
| 2005/0113765 | A1 | | 5/2005 | Veasey et al. |
| 2006/0153693 | A1 | | 7/2006 | Fiechter et al. |
| 2009/0275916 | A1 | | 11/2009 | Harms et al. |

FOREIGN PATENT DOCUMENTS

| | | | |
|---|---|---|---|
| EP | 0937471 | A2 | 8/1999 |
| EP | 0937476 | A2 | 8/1999 |
| FR | 1449518 | A | 8/1966 |
| JP | 60-070355 | A | 4/1985 |
| JP | 2001-017546 | A | 1/2001 |
| JP | 2003-164508 | A | 6/2003 |
| JP | 2007-136040 | A | 6/2007 |
| WO | 9938554 | A1 | 8/1999 |
| WO | 0110484 | A1 | 2/2001 |
| WO | 0149583 | A1 | 7/2001 |

OTHER PUBLICATIONS

English Translation of Abstract of Chinese Patent Application No. 202397817 dated Jul. 13, 2017.

* cited by examiner

ACCESS ASSEMBLY WITH A PIERCEABLE SEALING MEMBER

CROSS REFERENCE TO RELATED APPLICATIONS

The present application is a U.S. National Phase Application pursuant to 35 U.S.C. § 371 of International Application No. PCT/EP2014/050972 filed Jan. 20, 2014, which claims priority to European Patent Application No. 13152151.0 filed Jan. 22, 2013. The entire disclosure contents of these applications are herewith incorporated by reference into the present application.

FIELD OF INVENTION

The present invention relates to the field of access assemblies to provide access to the interior of a vessel or a fluid guide. In particular the invention relates to a sampling assembly to extract a sample from a vessel, typically containing a liquid substance. The access assembly is provided with a pierceable sealing member to withdraw a sample from inside the vessel by means of a piercing element, such like a tipped cannula.

BACKGROUND

Vessels and containers for storing or preparing liquid substances may be equipped with a sampling assembly, typically located in a sidewall of the vessel, by way of which a sample of the liquid can be extracted from the vessel without opening the same. There exist so called septum-based access assemblies, acting as a sampling assembly featuring a pierceable sealing member, typically denoted as septum. Such a septum is typically arranged in a passageway or in a through opening of a sampling assembly. The sealing member should provide a liquid- and gas-tight seal for the sampling assembly.

The pierceable sealing member typically comprises a polymeric, elastomeric or rubber-based material, which effectively seals the passageway extending through the sampling or access assembly. Moreover, the sealing member or the septum may be pierced by a tipped-cannula or by a respective needle assembly in such a way, that a free end of the cannula extends into the inner volume of the vessel in which the liquid substance is contained. If the cannula is for instance in fluid connection with a withdrawal device, such like a syringe a sample of the liquid can be extracted. Due to the elastic properties of the sealing member, the puncture of the sealing member can be effectively sealed after removal of the cannula or piercing member.

Depending on the overall geometry of the vessel, the medium contained therein and depending on the diameter or size of the sealing member, the sealing member may be subject to wear, e.g. when punctured or pierced multiple times. Therefore, the sealing member has to be replaced frequently. For a replacement of the sealing member it is typically necessary, that the vessel is substantially empty in order to prevent, that the content of the vessel gushes over an operator upon removal of the sealing member. This aspect is of extreme importance since the liquid medium stored in the container may comprise an acid or a comparably chemically aggressive liquid medium.

Moreover, conventional septum-based sampling or access assemblies may be provided with an additional closure, which is to be removed from a base of the sampling assembly to provide access to the pierceable sealing member located underneath. In situations, where the sealing member is not correctly mounted or when an inappropriate sealing member has been inadvertently used, removal of the outer closure may already lead to an uncontrolled discharge of the liquid medium into the environment.

It is therefore an object of the present invention to provide an improved access and/or sampling assembly that comes along with an enhanced security for an operator, both for extracting a probe as well as for replacing a pierceable sealing member. Moreover, it is a further aim to reduce a degree of potential contamination of the liquid medium located in the vessel during sample extraction. Additionally, the access assembly should be user friendly, both in terms of its general handling as well as in terms of cleaning the sampling assembly and/or the vessel, to which the access or sampling assembly is connected.

In another object, the access assembly should be adapted to provide clear and easily perceivable indicators to an operator in the event, that a malfunction of the access assembly is given, preferably without the danger, that the environment or the operator is contaminated with the content of the vessel to a large extend.

SUMMARY

In a first aspect, the invention relates to an access assembly to provide access to the interior of a vessel or a fluid guide, typically containing a liquid substance. The access assembly is particularly adapted to provide access to the interior of the vessel in order to extract a sample from a vessel. Hence, the access assembly may provide and serve as a sampling assembly. In the following, the invention will be described with regards to a vessel but it can also be deployed with a fluid guide for liquid and gaseous media.

The access assembly is not generally limited to, hence to the withdrawal of substances from the vessel. It may also serve to inject a liquid substance into the interior of the vessel. Moreover, the access assembly may also allow to at least removably insert arbitrary items or components into the interior of the vessel. The access assembly may for instance support insertion of a sensor or a measurement tip into the interior of the vessel.

The access assembly comprises a base to extend or actually extending through a sidewall of the vessel, which typically contains a liquid substance from which a sample should be withdrawn by means of the access- or sampling assembly. The base may serve as a nozzle or spout, typically extending outwardly from an outer sidewall of the vessel. In typical embodiments, the base may comprise an Ingold Probe, which is non-releasably connected to the vessel, in particular to a sidewall thereof.

The base comprises a tubular sealing portion providing a passageway axially extending therethrough. The tubular sealing portion typically comprises and provides a cylindrical or tubular-shaped inner sidewall section defining a passageway, through which sample extraction may take place.

Furthermore, the access assembly also comprises a pierceable sealing member, which is arranged across the sealing portion of the base to obstruct the passageway. Hence, the sealing member divides the passageway into a portion being in fluid connection with the inner volume of the vessel and an outside portion being in fluid connection with the environment. By puncturing or piercing the sealing member with a cannula or with a similar piercing element, access to the inner volume of the vessel can be provided and a respective amount of the liquid medium contained therein can be withdrawn.

The access assembly further comprises at least one closure member, which is axially displaceable relative to the base between a sealing position and a leakage position. In the sealing position, the closure member completely obstructs and seals the passageway through the base. By axially displacing the closure member, e.g. in a proximal direction, i.e., in a direction facing away from the vessel, the closure member only partially, in particular leakily obstructs the passageway. In said leakage position, the closure member is still securely arranged in the passageway but is no longer seals the passageway.

In the leakage position, the closure member allows that a controlled but limited leakage occurs, e.g. when the sealing member is for instance inappropriately used or mounted in the base. By means of axially displacing the at least one closure member between the closed or sealing position and the leakage position, a small and limited leakage can establish in a well-defined way prior to a large scaled discharge of the liquid medium occurs. Hence, in the leakage position, the closure member still obstructs a major portion of the cross-section of the passageway but allows that at least a small and controllable streamlet of the liquid medium may escape from the access assembly.

When an operator intends to replace the pierceable sealing member or when the operator intends to extract a sample through the sealing member, in the event that the vessel is not empty or when the sealing member is subject to malfunction, an initial axial and proximally-directed displacement of the at least one closure member may immediately release a small streamlet leaving the access assembly. Such a streamlet is a clear indication for the operator that the access assembly is subject to malfunction. Then, the operator may return the closure member into the sealing position and to take respective actions to prevent discharge of the liquid medium from the vessel on a large scale.

This way, uncontrolled discharge of the vessel through the access assembly can be effectively prevented. The at least one closure member therefore provides a backup feature and serves to provide a forced leakage in the event that the access assembly is subject to malfunction.

According to another embodiment, the closure member is axially displaceable from the sealing position via the leakage position into a release position relative to the base. In the release position, the closure member is detachable from the access assembly to provide access to the passageway extending through the base. The closure member is to be detached from the base to give way to the passageway, either for providing access to the sealing member for the purpose of sample extraction or for replacing the sealing member. Since the release position is only reachable from a sealing position via the intermediate leakage position, a potential leakage is detectable before the at least one closure member is releasable and/or removable from the access assembly and/or from its base.

According to a further embodiment, the at least one closure member comprises an annular groove in or at its outer circumference to receive a correspondingly shaped sealing rim. Preferably, the closure member is to be inserted into a correspondingly shaped tubular sealing portion, of e.g. the base. Hence, the outer circumference of the closure member may comprise an insert portion to at least partially insert the closure member into e.g. the tubular sealing portion of the base. When the sealing ring is mounted and arranged in the annular groove of the closure member, it may provide an effective seal between the closure member and a respective sealing portion of e.g. the base.

Typically, the sealing ring, e.g. in form of an O-ring is located in the annular groove of the closure member to engage with the tubular sealing portion of e.g. the base, when the closure member is positioned in the sealing position relative to the base. By means of an axial displacement of the closure member relative to the base, the sealing ring may disengage from the surrounding tubular sealing portion of e.g. the base, thereby allowing the liquid medium of the vessel to bypass the sealing ring. However, in the intermediate leakage position or leakage configuration, the cross-section between the sealing ring of the closure member and the corresponding tubular sealing portion is comparatively small, to limit the stream and/or the amount of the discharging liquid medium.

In another preferred embodiment, the access assembly further comprises an insert which is axially slidingly displaceable in the base between a sealing position, a leakage position and a release position relative to the base. The insert may also comprise a generally tubular shape and may sealingly engage with the base of the access assembly. The insert and the base of the access assembly may be co-aligned and may be arranged concentrically or coaxially at least in part.

The insert may equally serve as a mount for at least one closure member, so that a distally-directed relative displacement of the at least one closure member relative to the base may be conducted by means of a corresponding axially-directed relative displacement between insert and base. Here, the at least one closure member may even remain fixed to the insert. Moreover, the at least one sealing member may be axially displaceable also relative to the insert, between a sealing position, a leakage position and a release position. This way, the access assembly may comprise a twofold forced and small dimensioned leakage.

According to another aspect, the insert is rotatably locked to the base by means of at least one radially extending projection engaged with an axially extending groove. Hence, the insert and the base are mutually interconnected by means of a kind of splined interconnection inhibiting a relative rotation but allowing axially-directed relative displacement of base and insert. Typically, it may be the insert which comprises at least one radially extending projection to engage with a correspondingly-shaped but axially extending groove located at an inside wall of the base that receives the insert and its radially outwardly extending projection. Typically, the insert not only comprises one projection but may feature two, three or even more radially outwardly extending projections arranged in a regular manner along the outer circumference of the insert.

In a typical embodiment the insert comprises three radially outwardly extending projections to mate with correspondingly shaped and correspondingly arranged axially extending grooves of the base. The projections and grooves are equidistantly arranged at the outer circumference of the insert. When having three projections neighbouring projections are separated by about 120°. When having four projections neighbouring projections will be separated by about 90° and so on. Also here it is conceivable that at least one of the various projections is located at the base while at least one corresponding and axially extending groove is located at the insert.

In an alternative embodiment it is also conceivable, that it is the base which comprises e.g. radially inwardly extending projections to mate and to engage with correspondingly-shaped but axially extending radially inwardly extending grooves provided at an outer circumference or outer sidewall portion of the insert.

In a further preferred embodiment, the access assembly comprises two closure members, namely a proximal closure member to engage with the insert and a distal closure member, which sealingly engages with the tubular sealing portion of the base. Moreover, also the second or distal closure member may be engaged or connected with the insert but it is typically axially displaced and axially separated from the proximal closure member.

Irrespective of the number of closure members, the insert may comprise a tubular sealing portion to engage with a sealing ring of a proximal closure member, when said closure member is in sealing position relative to the insert. When the insert is immobilised or fixed to the base, the proximal closure member may be transferable between the sealing position and the leakage position relative to the insert and hence relative to the base. In detail, the proximal closure member is axially displaceable relative to the base and to the insert simultaneously between the sealing position and the leakage position. By a relative displacement of the proximal closure member and the insert, a forced leakage can be provided already when the proximal closure member is displaced from a distally located sealing position into a proximally displaced leakage position.

In a further embodiment and in order to provide a forced leakage, the insert comprises a radially widening portion axially adjacent to the sealing portion in proximal direction. In this way, the sealing ring of the proximal closure member can be received in the radially widening portion when the proximal closure member reaches the leakage position or when said closure member is located in the leakage position relative to the insert. By axially displacing the proximal closure member relative to the insert, its sealing ring may disengage from the corresponding sealing portion and may be axially shifted into and towards the radially widening portion.

The radial widening of the insert provides a disengagement of the sealing ring of the proximal closure member when said closure member reaches the leakage position. As a consequence, an at least limited discharge or a small streamlet of the liquid medium contained in the vessel may bypass the opened or released seal while the proximal closure member is still engaged and still substantially but no longer completely obstructs the passageway extending through the base and through the insert.

In a further embodiment, the proximal closure member is threadedly engaged with the insert. Hence, an axial displacement of the proximal closure member relative to the insert may be conducted by a screwing of the proximal closure member relative to the insert. The proximal closure member comprises an outer thread typically engaging with a correspondingly shaped inner thread located at an inside-facing sidewall portion of the insert. The axial extension of the mutually engaging threads of the proximal closure member and of the insert is such, that the proximal closure member is and remains threadedly engaged with the insert in the sealing position as well in the leakage position.

Typically, the threaded engagement of proximal dosing member and insert is penetrable by the liquid medium. Hence, the threaded engagement is of non-sealing type. A sealing function between insert and proximal closure member is exclusively attainable by the sealing ring of the proximal closure member radially engaging with the tubular sealing portion of the insert.

By separating the seal and the threaded engagement, a forced and small-scaled leakage can be provided in a configuration, in which the sealing ring of the proximal closure member is no longer engaged with the tubular sealing portion of the insert while the mutually corresponding threads of insert and proximal closure member are still in engagement, thereby keeping the passageway extending through the insert substantially obstructed by the proximal closure member.

According to a further preferred embodiment, the insert also comprises a distally extending and radially inwardly tapering inside wall portion adjacent to the sealing portion. In this context, the distal direction extends towards the interior of the vessel, to which the access assembly is fixable or is actually fixed. By providing a diameter reducing tapering inside wall portion in distal direction, a needle assembly to be inserted into and to be guided all the way through the insert to hit the sealing member can be effectively deflected and guided.

Depending on the overall length of the access assembly, its base and/or of its insert, the sealing member or septum located in the passageway may be hard or difficult to recognize. By providing radially inwardly extending tapering sidewall portions of the insert extending towards the sealing member, which is typically arranged in a central portion of the base and/or of the insert, the tipped piercing element can be effectively deflected from such tapered sidewall portions without significantly blunting.

For the sake of not inadvertently contaminating the interior of the vessel it is of importance, that the piercing element remains substantially sharp and tipped. Otherwise, with a blunt piercing element, a respective portion of the sealing member may be punched out, thereby transporting the punched portion of the sealing member into the interior of the vessel which may have a negative effect in the quality of the liquid substance contained therein. Additionally, with a blunt piercing element, the sealing member may rapidly deteriorate or may become rapidly subject to malfunction.

The insert may even comprise at least two or even several radially stepping down but axially separated radially inwardly tapering inside wall portions. In particular, the distally extending and radially inwardly tapering inside wall portion may also be provided adjacent to and proximal to the sealing portion of the insert. This additional distally and radially inwardly tapering inside wall portion of the insert may also serve as the afore mentioned radially widening portion extending in proximal direction, by way of which the annular sealing ring of the proximal closure member may disengage from the sealing position or sealing configuration. Hence the inwardly tapering inside wall portion fulfils a double function. It serves as a guiding structure during needle insertion and also supports a leakage generating release of the sealing ring from the sealing portion of the insert.

In a further embodiment, the insert also comprises a radially outwardly extending flange at its outer circumference to engage with a radially inwardly extending flange of a fastening ring, which is threadedly engageable with a proximal outer thread of the base. Here, the fastening ring may serve as a union nut by way of which the insert can be axially fixed to the insert. Release and axial displacement of the insert, e.g. for the purpose of replacing or exchanging a pierceable sealing member therefore requires to initially release the fastening ring and to slidingly displace the insert in proximal direction relative to the base.

According to another embodiment, a second or distal closure member is slidingly displaceable in the sealing portion of the base, which extends into a radially widened portion in proximal direction. Generally, the distal closure member can be implemented without and independent of the proximal closure member and vice versa. Typically, the distal closure member can be provided at a distal end of the insert. Comparable to the proximal closure member also the distal closure member may comprise a sealing ring extending in an annular groove thereof to sealingly engage with the tubular sealing portion of the base when the distal closure member and/or the insert, to which the distal closure member may be fixed, is in the sealing position relative to the base.

Axially displacing the distal closure member and/or the insert from the sealing position into the leakage position comes along with a distally-directed displacement of the distal closure member's sealing ring into the radially widened portion of the base. In this leakage position, the distal closure member still substantially obstructs the passageway of the base in a non-sealing, hence in a leaky way. Axially and proximally-directed displacement of the distal closure member into its leaking position relative to the base may be accompanied by a respective release of the fastening ring, thereby allowing the insert to be displaced in axial and proximal direction to such an extent, that the sealing ring of the distal closure member reaches the radially widened portion of the base.

In this leakage position, the insert is still fixed to the base but the distal closure member no longer seals the passageway extending therethrough. As a consequence, a limited streamlet may form and may discharge through the released seal. This will indicate to an operator, that the vessel is still filled with a liquid substance which does not allow for a replacement and a temporal removal of the sealing member. Hence, an operator willing to completely remove the insert from the base for the purpose of replacing a sealing member will immediately detect that something is wrong when unscrewing the fastening ring and when starting to withdraw the insert in proximal direction from the base. In response to a small-sized streamlet discharging through the access assembly, the operator may quickly return the insert and the fastening ring into the sealing position.

According to another embodiment, the distal closure member comprises a proximally opened or cupped receptacle to receive the pierceable sealing member. Typically, the closure member comprises a central through opening to expose the sealing member in the passageway and for not obstructing the sealing member when located or arranged in the receptacle of the distal closure member.

Furthermore, the distal closure member is releasably assembled or releasably attached to a distal end of the insert. For this purpose, the receptacle of the distal closure member may be threadedly engageable with a correspondingly threaded distal end section of the insert. By screwing the distal closure member onto the distal end section of the insert, the sealing member may be constrained between a distal end face of the distal closure member and a distal end face of the insert.

By mounting the distal closure member on the distal end of the insert in a threaded way it is of particular benefit that removal and insertion of the insert into the base, to which the distal closure member is sealed, is of non-rotating but axial sliding type. In this way, an axially-directed sliding of the insert relative to the base has no influence on the mutual assembly of insert and distal closure member. Otherwise, if the insert were threadedly engaged with the base, a screwing motion of the insert relative to the base could lead to an uncontrolled loosening of the distal closure member from the distal end section of the insert since the sealing ring of the distal closure member typically engages with the tubular sealing portion of the base when the distal closure member and hence the insert is or are in the sealing position.

According to another preferred embodiment, the distal closure member comprises an annular rim having at least two radially outwardly extending recesses on a distal end of an inside wall portion. The at least two radially outwardly extending recesses are particularly designed to receive a tool for screwing or unscrewing the distal closure member to or from the distal end of the insert. In this way, the outer circumference of the distal closure member can be shaped and designed free of any recesses or spanner flats.

Such a configuration is of particular benefit when the distal closure member extends into the interior of the vessel. In preferred embodiments, the distal closure member and in particular its distal end face is flush with an inside wall portion of the vessel. By having the recesses located on an inside wall portion of the closure member, the interface between the outer circumference of the distal closure member and the respective through opening of the inner sidewall of the vessel can be formed and designed void of any gaps or recesses. In this way, cleaning of the vessel and the distal closure member can be simplified and improved.

According to another embodiment, the access assembly is designed as and comprises a sampling assembly by way of which a sample is extractable from the interior of the vessel. The sampling assembly is particularly adapted to support and to allow withdrawal of a liquid substance from the interior of the vessel through the vessel's sidewall.

In still another but independent aspect the invention also relates to a vessel to receive a liquid medium, such like a pharmaceutical pre-product, a drug, a medicament or a liquid medium to be used in the chemical industry. The vessel further comprises at least one access assembly as described above, which is typically arranged at a sidewall of the vessel, typically in close proximity of a bottom portion of said vessel.

The term "drug" or "medicament", as used herein, means a pharmaceutical formulation containing at least one pharmaceutically active compound, wherein in one embodiment the pharmaceutically active compound has a molecular weight up to 1500 Da and/or is a peptide, a proteine, a polysaccharide, a vaccine, a DNA, a RNA, an enzyme, an antibody or a fragment thereof, a hormone or an oligonucleotide, or a mixture of the above-mentioned pharmaceutically active compound, wherein in a further embodiment the pharmaceutically active compound is useful for the treatment and/or prophylaxis of diabetes mellitus or complications associated with diabetes mellitus such as diabetic retinopathy, thromboembolism disorders such as deep vein or pulmonary thromboembolism, acute coronary syndrome (ACS), angina, myocardial infarction, cancer, macular degeneration, inflammation, hay fever, atherosclerosis and/or rheumatoid arthritis, wherein in a further embodiment the pharmaceutically active compound comprises at least one peptide for the treatment and/or prophylaxis of diabetes mellitus or complications associated with diabetes mellitus such as diabetic retinopathy, wherein in a further embodiment the pharmaceutically active compound comprises at least one human insulin or a human insulin analogue or derivative, glucagon-like peptide (GLP-1) or an analogue or derivative thereof, or exendin-3 or exendin-4 or an analogue or derivative of exendin-3 or exendin-4.

Insulin analogues are for example Gly(A21), Arg(B31), Arg(B32) human insulin; Lys(B3), Glu(B29) human insulin; Lys(B28), Pro(B29) human insulin; Asp(B28) human insulin; human insulin, wherein proline in position B28 is replaced by Asp, Lys, Leu, Val or Ala and wherein in position B29 Lys may be replaced by Pro; Ala(B26) human insulin; Des(B28-B30) human insulin; Des(B27) human insulin and Des(B30) human insulin.

Insulin derivates are for example B29-N-myristoyl-des(B30) human insulin; B29-N-palmitoyl-des(B30) human insulin; B29-N-myristoyl human insulin; B29-N-palmitoyl human insulin; B28-N-myristoyl LysB28ProB29 human insulin; B28-N-palmitoyl-LysB28ProB29 human insulin; B30-N-myristoyl-ThrB29LysB30 human insulin; B30-N-palmitoyl-ThrB29LysB30 human insulin; B29-N—(N-palmitoyl-Y-glutamyl)-des(B30) human insulin; B29-N—(N-lithocholyl-Y-glutamyl)-des(B30) human insulin; B29-N-(ω-carboxyheptadecanoyl)-des(B30) human insulin and B29-N-(ω-carboxyheptadecanoyl) human insulin.

Exendin-4 for example means Exendin-4(1-39), a peptide of the sequence H-His-Gly-Glu-Gly-Thr-Phe-Thr-Ser-Asp-Leu-Ser-Lys-Gln-Met-Glu-Glu-Glu-Ala-Val-Arg-Leu-Phe-Ile-Glu-Trp-Leu-Lys-Asn-Gly-Gly-Pro-Ser- Ser-Gly-Ala-Pro-Pro-Pro-Ser-NH2.

Exendin-4 derivatives are for example selected from the following list of compounds:

H-(Lys)4-des Pro36, des Pro37 Exendin-4(1-39)-NH2,

H-(Lys)5-des Pro36, des Pro37 Exendin-4(1-39)-NH2, des Pro36 Exendin-4(1-39), des Pro36 [Asp28] Exendin-4(1-39), des Pro36 [IsoAsp28] Exendin-4(1-39), des Pro36 [Met(O)14, Asp28] Exendin-4(1-39), des Pro36 [Met(O)14, IsoAsp28] Exendin-4(1-39), des Pro36 [Trp(O2)25, Asp28] Exendin-4(1-39), des Pro36 [Trp(O2)25, IsoAsp28] Exendin-4(1-39), des Pro36 [Met(O)14 Trp(O2)25, Asp28] Exendin-4(1-39), des Pro36 [Met(O)14 Trp(O2)25, IsoAsp28] Exendin-4 (1-39); or des Pro36 [Asp28] Exendin-4(1-39), des Pro36 [IsoAsp28] Exendin-4(1-39), des Pro36 [Met(O)14, Asp28] Exendin-4(1-39), des Pro36 [Met(O)14, IsoAsp28] Exendin-4(1-39), des Pro36 [Trp(O2)25, Asp28] Exendin-4(1-39), des Pro36 [Trp(O2)25, IsoAsp28] Exendin-4(1-39), des Pro36 [Met(O)14 Trp(O2)25, Asp28] Exendin-4(1-39), des Pro36 [Met(O)14 Trp(O2)25, IsoAsp28] Exendin-4 (1-39), wherein the group -Lys6-NH2 may be bound to the C-terminus of the Exendin-4 derivative;

or an Exendin-4 derivative of the sequence des Pro36 Exendin-4(1-39)-Lys6-NH2 (AVE0010), H-(Lys)6-des Pro36 [Asp28] Exendin-4(1-39)-Lys6-NH2, des Asp28 Pro36, Pro37, Pro38Exendin-4(1-39)-NH2, H-(Lys)6-des Pro36, Pro38 [Asp28] Exendin-4(1-39)-NH2, H-Asn-(Glu)5des Pro36, Pro37, Pro38 [Asp28] Exendin-4(1-39)-NH2, des Pro36, Pro37, Pro38 [Asp28] Exendin-4(1-39)-(Lys) 6-NH2, H-(Lys)6-des Pro36, Pro37, Pro38 [Asp28] Exendin-4(1-39)-(Lys)6-NH2, H-Asn-(Glu)5-des Pro36, Pro37, Pro38 [Asp28] Exendin-4(1-39)-(Lys)6-NH2, H-(Lys)6-des Pro36 [Trp(O2)25, Asp28] Exendin-4(1-39)-Lys6-NH2, H-des Asp28 Pro36, Pro37, Pro38 [Trp(O2)25] Exendin-4(1-39)-NH2, H-(Lys)6-des Pro36, Pro37, Pro38 [Trp(O2)25, Asp28] Exendin-4(1-39)-NH2, H-Asn-(Glu)5-des Pro36, Pro37, Pro38 [Trp(O2)25, Asp28] Exendin-4(1-39)-NH2, des Pro36, Pro37, Pro38 [Trp(O2)25, Asp28] Exendin-4 (1-39)-(Lys)6-NH2, H-(Lys)6-des Pro36, Pro37, Pro38 [Trp(O2)25, Asp28] Exendin-4(1-39)-(Lys)6-NH2, H-Asn-(Glu)5-des Pro36, Pro37, Pro38 [Trp(O2)25, Asp28] Exendin-4(1-39)-(Lys)6-NH2, H-(Lys)6-des Pro36 [Met(O)14, Asp28] Exendin-4(1-39)-Lys6-NH2, des Met(O)14 Asp28 Pro36, Pro37, Pro38 Exendin-4(1-39)-NH2, H-(Lys)6-desPro36, Pro37, Pro38 [Met(O)14, Asp28] Exendin-4(1-39)-NH2, H-Asn-(Glu)5-des Pro36, Pro37, Pro38 [Met(O)14, Asp28] Exendin-4(1-39)-NH2, des Pro36, Pro37, Pro38 [Met(O)14, Asp28] Exendin-4 (1-39)-(Lys)6-NH2, H-(Lys)6-des Pro36, Pro37, Pro38 [Met(O)14, Asp28] Exendin-4(1-39)-(Lys)6-NH2, H-Asn-(Glu)5 des Pro36, Pro37, Pro38 [Met(O)14, Asp28] Exendin-4(1-39)-(Lys)6-NH2, H-Lys6-des Pro36 [Met(O)14, Trp(O2)25, Asp28] Exendin-4(1-39)-Lys6-NH2, H-des Asp28 Pro36, Pro37, Pro38 [Met(O)14, Trp(O2)25] Exendin-4(1-39)-NH2, H-(Lys)6-des Pro36, Pro37, Pro38 [Met(O)14, Asp28] Exendin-4(1-39)-NH2, H-Asn-(Glu)5-des Pro36, Pro37, Pro38 [Met(O)14, Trp (O2)25, Asp28] Exendin-4(1-39)-NH2, des Pro36, Pro37, Pro38 [Met(O)14, Trp(O2)25, Asp28] Exendin-4(1-39)-(Lys)6-NH2, H-(Lys)6-des Pro36, Pro37, Pro38 [Met(O)14, Trp(O2) 25, Asp28] Exendin-4(S1-39)-(Lys)6-NH2, H-Asn-(Glu)5-des Pro36, Pro37, Pro38 [Met(O)14, Trp (O2)25, Asp28] Exendin-4(1-39)-Lys)6-NH2;

or a pharmaceutically acceptable salt or solvate of any one of the afore-mentioned Exendin-4 derivative.

Hormones are for example hypophysis hormones or hypothalamus hormones or regulatory active peptides and their antagonists as listed in Rote Liste, ed. 2008, Chapter 50, such as Gonadotropine (Follitropin, Lutropin, Choriongonadotropin, Menotropin), Somatropine (Somatropin), Desmopressin, Terlipressin, Gonadorelin, Triptorelin, Leuprorelin, Buserelin, Nafarelin, Goserelin.

A polysaccharide is for example a glucosaminoglycane, a hyaluronic acid, a heparin, a low molecular weight heparin or an ultra low molecular weight heparin or a derivative thereof, or a sulphated, e.g. a poly-sulphated form of the above-mentioned polysaccharides, and/or a pharmaceutically acceptable salt thereof. An example of a pharmaceutically acceptable salt of a poly-sulphated low molecular weight heparin is enoxaparin sodium.

Antibodies are globular plasma proteins (~150 kDa) that are also known as immunoglobulins which share a basic structure. As they have sugar chains added to amino acid residues, they are glycoproteins. The basic functional unit of each antibody is an immunoglobulin (Ig) monomer (containing only one Ig unit); secreted antibodies can also be dimeric with two Ig units as with IgA, tetrameric with four Ig units like teleost fish IgM, or pentameric with five Ig units, like mammalian IgM.

The Ig monomer is a "Y"-shaped molecule that consists of four polypeptide chains; two identical heavy chains and two identical light chains connected by disulfide bonds between cysteine residues. Each heavy chain is about 440 amino acids long; each light chain is about 220 amino acids long. Heavy and light chains each contain intrachain disulfide bonds which stabilize their folding. Each chain is composed of structural domains called Ig domains. These domains contain about 70-110 amino acids and are classified into different categories (for example, variable or V, and constant or C) according to their size and function. They have a characteristic immunoglobulin fold in which two β sheets create a "sandwich" shape, held together by interactions between conserved cysteines and other charged amino acids.

There are five types of mammalian Ig heavy chain denoted by α, δ, ϵ, γ, and μ. The type of heavy chain present defines the isotype of antibody; these chains are found in IgA, IgD, IgE, IgG, and IgM antibodies, respectively.

Distinct heavy chains differ in size and composition; α and γ contain approximately 450 amino acids and 6 approximately 500 amino acids, while μ and ϵ have approximately 550 amino acids. Each heavy chain has two regions, the constant region ($C_H$) and the variable region ($V_H$). In one species, the constant region is essentially identical in all antibodies of the same isotype, but differs in antibodies of different isotypes. Heavy chains γ, α and δ have a constant region composed of three tandem Ig domains, and a hinge region for added flexibility; heavy chains μ and ϵ have a constant region composed of four immunoglobulin domains. The variable region of the heavy chain differs in antibodies produced by different B cells, but is the same for all antibodies produced by a single B cell or B cell clone. The variable region of each heavy chain is approximately 110 amino acids long and is composed of a single Ig domain.

In mammals, there are two types of immunoglobulin light chain denoted by λ and κ. A light chain has two successive domains: one constant domain (CL) and one variable domain (VL). The approximate length of a light chain is 211 to 217 amino acids. Each antibody contains two light chains that are always identical; only one type of light chain, κ or λ, is present per antibody in mammals.

Although the general structure of all antibodies is very similar, the unique property of a given antibody is determined by the variable (V) regions, as detailed above. More specifically, variable loops, three each the light (VL) and three on the heavy (VH) chain, are responsible for binding to the antigen, i.e. for its antigen specificity. These loops are referred to as the Complementarity Determining Regions (CDRs). Because CDRs from both VH and VL domains contribute to the antigen-binding site, it is the combination of the heavy and the light chains, and not either alone, that determines the final antigen specificity.

An "antibody fragment" contains at least one antigen binding fragment as defined above, and exhibits essentially the same function and specificity as the complete antibody of which the fragment is derived from. Limited proteolytic digestion with papain cleaves the Ig prototype into three fragments. Two identical amino terminal fragments, each containing one entire L chain and about half an H chain, are the antigen binding fragments (Fab). The third fragment, similar in size but containing the carboxyl terminal half of both heavy chains with their interchain disulfide bond, is the crystalizable fragment (Fc). The Fc contains carbohydrates, complement-binding, and FcR-binding sites. Limited pepsin digestion yields a single F(ab')2 fragment containing both Fab pieces and the hinge region, including the H—H interchain disulfide bond. F(ab')2 is divalent for antigen binding. The disulfide bond of F(ab')2 may be cleaved in order to obtain Fab'. Moreover, the variable regions of the heavy and light chains can be fused together to form a single chain variable fragment (scFv).

Pharmaceutically acceptable salts are for example acid addition salts and basic salts. Acid addition salts are e.g. HCl or HBr salts. Basic salts are e.g. salts having a cation selected from alkali or alkaline, e.g. Na+, or K+, or Ca2+, or an ammonium ion N+(R1)(R2)(R3)(R4), wherein R1 to R4 independently of each other mean: hydrogen, an optionally substituted C1-C6-alkyl group, an optionally substituted C2-C6-alkenyl group, an optionally substituted C6-C10-aryl group, or an optionally substituted C6-C10-heteroaryl group. Further examples of pharmaceutically acceptable salts are described in "Remington's Pharmaceutical Sciences" 17. ed. Alfonso R. Gennaro (Ed.), Mark Publishing Company, Easton, Pa., U.S.A., 1985 and in Encyclopedia of Pharmaceutical Technology.

Pharmaceutically acceptable solvates are for example hydrates.

It will be further apparent to those skilled in the pertinent art that various modifications and variations can be made to the present invention without departing from the spirit and scope of the invention. Further, it is to be noted, that any reference signs used in the appended claims are not to be construed as limiting the scope of the present invention.

BRIEF DESCRIPTION OF THE DRAWINGS

In the following, preferred embodiments of the invention will be described by making reference to the drawings, in which.

DETAILED DESCRIPTION

The access assembly 10 as illustrated in FIGS. 1-5 is intended to be attached to a sidewall 14 of a vessel 12. As shown in FIGS. 1-5, the access assembly 10 comprises a tubular-shaped base 20, which extends outwardly from the sidewall 14 of the vessel 12. The access assembly 10 and/or its base 20 serves as a discharge nozzle or spout, especially for extracting small sized samples from the liquid medium contained therein and confined by the vessel 12.

Figure 1:
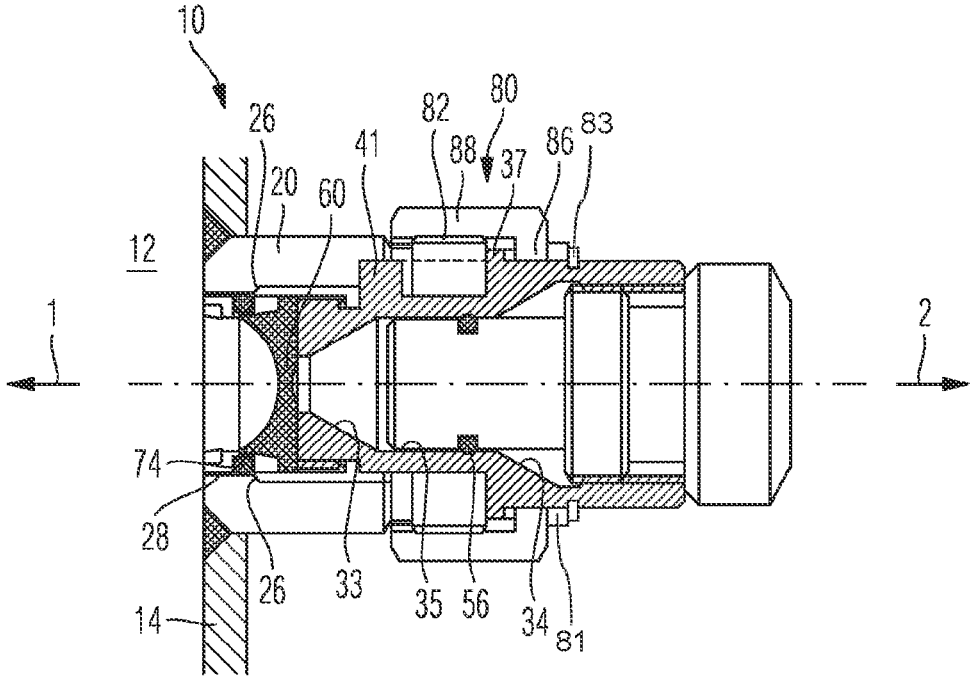
FIG. 1 schematically illustrates a cross-section through the access assembly in a sealing configuration.
Figure 8A:
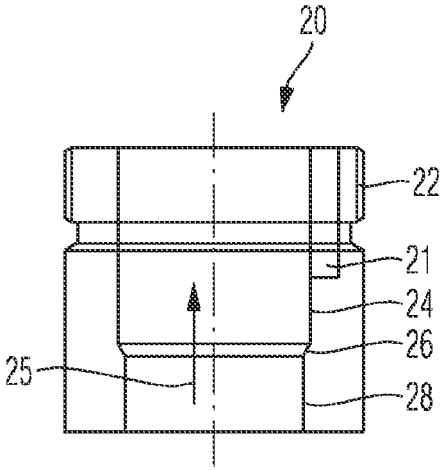
FIG. 8*b* shows the base in radial cross-section, FIG. 9 provides an isolated side view of the proximal closure member.

As further indicated in FIG. 1, a distal direction 1 points to the interior of the vessel 12 while an opposite proximal direction 2 points away from the outside of the vessel's 12 sidewall 14. Axial displacement of various components or parts of the access assembly 10 typically occurs either in distal-direction 1 or in proximal-direction 2. As shown in FIG. 8*a*, the base 20 comprises a tubular-shaped sealing portion 28, which in sealing position as shown in FIG. 1 engages with an annular sealing ring 74 of a distal closure member 70. Adjacent to the tubular sealing portion 28 and in proximal-direction 2 there is provided a radially widening frusto-conical or tapered sidewall portion 26 extended into a receiving portion 24, which is also of tubular shape. As illustrated in FIG. 8*a*, the inner and free diameter of the receiving portion 24 is larger than the diameter of the sealing portion 28.

Figure 6A:
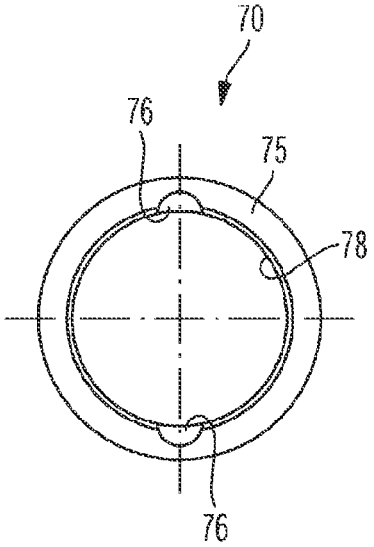
FIG. 6*b* shows a longitudinal cross-section through the distal closure member according to FIG. 6*a*.
Figure 6B:
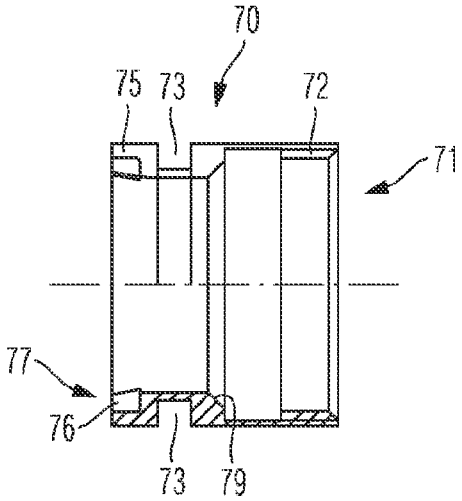

The base 20 is adapted to sealingly engage with the distal closure member 70, which comprises an annular groove 73 to receive a correspondingly-shaped sealing ring 74, typically in form of an O-ring of elastomeric material. As for instance illustrated in FIGS. 6*a* and 6*b*, the distal closure member 70 comprises a sleeve-like geometry and features a proximally extending receptacle 71 to receive a pierceable sealing member 60 extending all over the inner diameter of the distal closure member 70. By means of the pierceable sealing member 60, the passageway 25 through the distal closure member 70 can be substantially obstructed.

Figure 10:
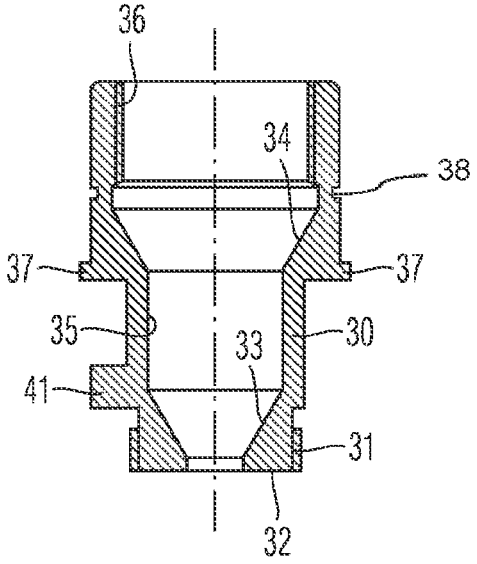
FIG. 10 shows a longitudinal cross-section through the insert and FIG. 11 depicts an isolated cross-section through a fastening ring.

At its proximal end, the distal closure member 70 comprises an inner thread 72 by way of which the distal closure member 70 can be releasably engaged with a distal end portion of an insert 30 as illustrated in FIG. 10. Hence, the inner thread 72 of the distal closure member 70 may threadedly engage with an outer thread 31 of the insert 30. Additionally, the distal closure member 70 comprises a stepped down portion or a ledge 79 that serves as a distal abutment for the pierceable sealing member 60. When screwing the distal closure member 70 onto the distal end of the insert 30, the sealing member 60 or septum can be clamped or constrained between said ledge 79 and a distal end face 32 of the insert 30.

In the sealing position as illustrated in FIG. 1, the sealing ring 74 radially abuts with the tubular sealing portion 28 of the base 20. Since the interior or the through opening formed by the distal closure member 70 is obstructed by the pierceable sealing member, the entire passageway 25 extending through the base 20 is obstructed in a sealed and liquid tight way.

Figure 11:
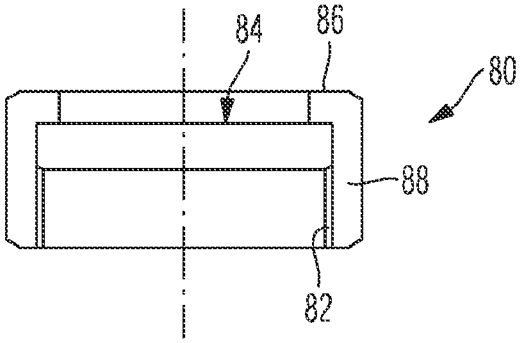

The insert 30 comprises a radially outwardly extending flange 37, which engages with a radially inwardly extending flange 86 of a fastening ring 80, which is separately illustrated in FIG. 11. The fastening ring 80 comprises a sidewall 88 provided with an inner thread 82 which is adapted to threadedly engage with a proximally located outer thread 22 of the base 20. In the sealing position as shown in FIG. 1, the fastening ring 86 receives the insert 30 in its through opening 84 and is further threadedly engaged with the base 20. By means of the mutually engaging flange portions 86 and 37, the insert 30 is axially constrained and axially fixed to the base 20. In this configuration, the sealing ring 74 is sealingly engaged with the tubular sealing portion 28 of the base 20.

Figure 2:
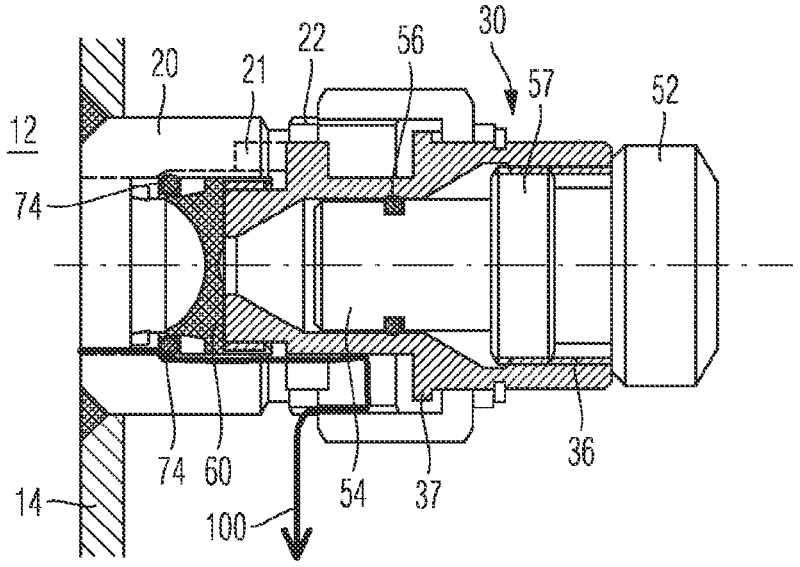
FIG. 2 shows the access assembly according to FIG. 1 with the insert displaced in leakage position and FIG. 3 shows the access assembly according to FIGS. 1 and 2 with a removed or released insert.

By at least partially unscrewing the fastening ring 80 as indicated in FIG. 2, the insert can be displaced in proximal direction 2 so that the sealing ring 74 of the distal closure member 70 slides along the frusto-conical sidewall portion 26 to reach the receiving portion 24. In this configuration, the seal is no longer active and a forced leakage may evolve in form of a streamlet 100 extending through the interface of base 20 and distal closure member 70.

However, in the leakage position as indicated in FIG. 2, the insert 30 is still fixed to the base 20 since the mutually engaging threads 82 and 22 of fastening ring 80 and base 20 are still in mutual engagement. In this configuration, the distal closure member 70 and the sealing member 60 still obstruct a major portion of the diameter of the passageway 25 of the base 20. Hence, in the leakage position only a fairly small streamlet 100 may evolve and escape from the access assembly 10 in a rather controlled way.

In addition and as illustrated in FIG. 1 there may be also provided a slide ring 81 at a proximal end of the fastening ring 80. The slide ring 81 may be further engaged with a locking ring 83 which is adapted to radially engage with an annular groove 38 on the outer circumference of the insert 30, as illustrated in FIG. 10. The slide ring 81 and/or the locking ring 83 may be designed as an integral component or portion of the fastening ring 80. Slide ring 81 and/or fastening ring 83 may be also provided as a separate part to be assembled with the fastening ring 80.

Figure 3:
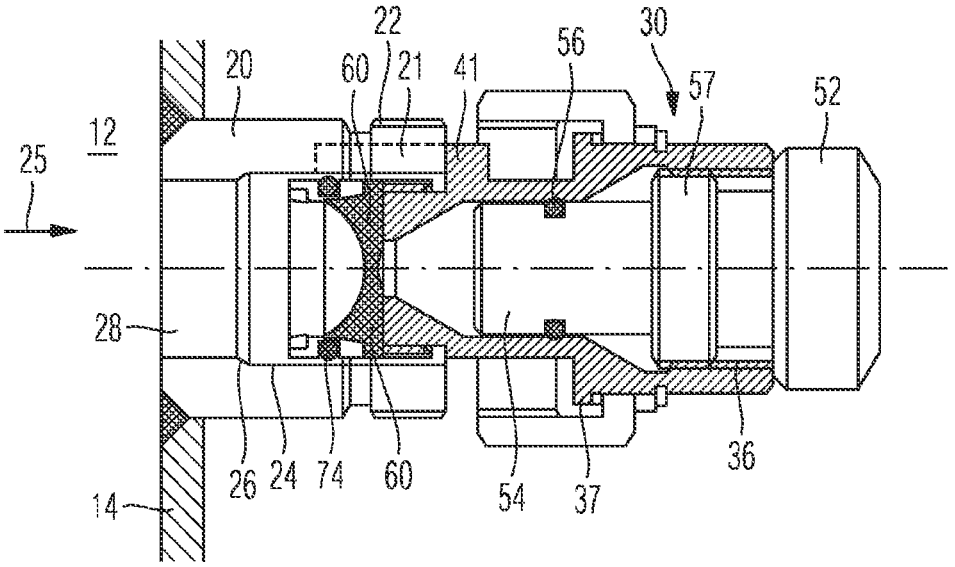

Removal of the insert 30 from the base 20 is particularly necessary to replace a pierceable sealing member 60, e.g. a septum. In the event that the vessel 12 is still filled with a liquid substance, an operator will immediately observe the draining streamlet 100 and may return the insert 30 and the fastening ring 80 into the sealing position as indicated in FIG. 1. It is only when no streamlet 100 evolves in the leakage position that it is recommendable to completely unscrew the fastening ring 80 from the base 20 in order to slidingly displace the insert 30 into a release position as indicated in FIG. 3.

Figure 7A:
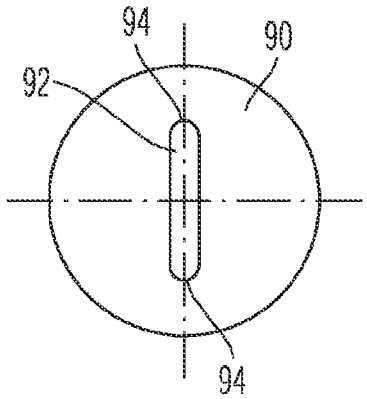
FIG. 7*a* shows a planar view of a tool to engage with the distal closure member.
Figure 7B:
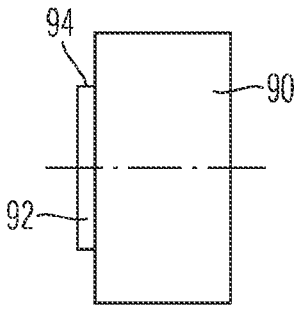
FIG. 7*b* shows the tool according to FIG. 7*a* in cross-section, FIG. 8*a* schematically illustrates a longitudinal cross-section through the base in an isolated view.

In this configuration, the entire insert 30 with the distal closure member 70 assembled thereon can be removed from the base 20 for replacing the pierceable sealing member 60. For this purpose, the distal closure member 70 comprises radially outwardly extending and diametrically oppositely located recesses 76 at an inside wall 78 of a distal rim 75 at its distal end face 77. As indicated in FIGS. 7*a* and 7*b*, a tool 90 comprising a correspondingly-shaped projection 92 with lateral and oppositely located rounded end sections 94 can be inserted into the oppositely located recesses 76 in order to transfer an angular momentum to the distal closure member 70 for the purpose of unscrewing the same from the distal end of the insert 30.

The radially outwardly extending recesses 76 are of particular benefit especially for cleaning of the access assembly 10 and/or of the vessel 12 receiving the same. In preferred embodiments, the distal end face 77 of the distal closure member 70 is flush with the inside wall of the vessel 12. Since the outer circumference of the rim 75 is of annular and recess-free shape, no grooves or recesses will be formed in the interface between the rim 75 and the surrounding sidewall 14 of the vessel 12. This way, the interface between distal closure member 70 and sidewall 14 of the vessel 12 can be easily cleaned.

For extracting of a sample from the interior of the vessel 12 by making use of the pierceable sealing member 60, the proximal closure member 50 substantially obstructing the passageway 25 through the insert 30 has to be removed. Also here, a forced leakage mechanism is implemented in a similar way as already described with respect to the distal closure member 70 and the base 20. The insert 30 is also of tubular shape and comprises a tubular-shaped sealing portion 35, which engages with an annular sealing ring 56 located in an annular groove 55 of the proximal closure member 50. Moreover, the passageway 25 also extends through the insert 30.

The proximal closure member 50 comprises a stepped down shaft 54 at its distal end in which the annular groove 55 is located. Adjacent to the shaft 54, there is provided a radially widened flange or disc portion 57 featuring an outer thread 58 to engage with an inner thread 36 located at a proximal end of the insert 30. The proximal closure member 50 further comprises a handle portion or a radially widened grip section 52 at its proximal end allowing to induce a torque for screwing or unscrewing the proximal closure member 52 to and from the insert 30.

Figure 4:
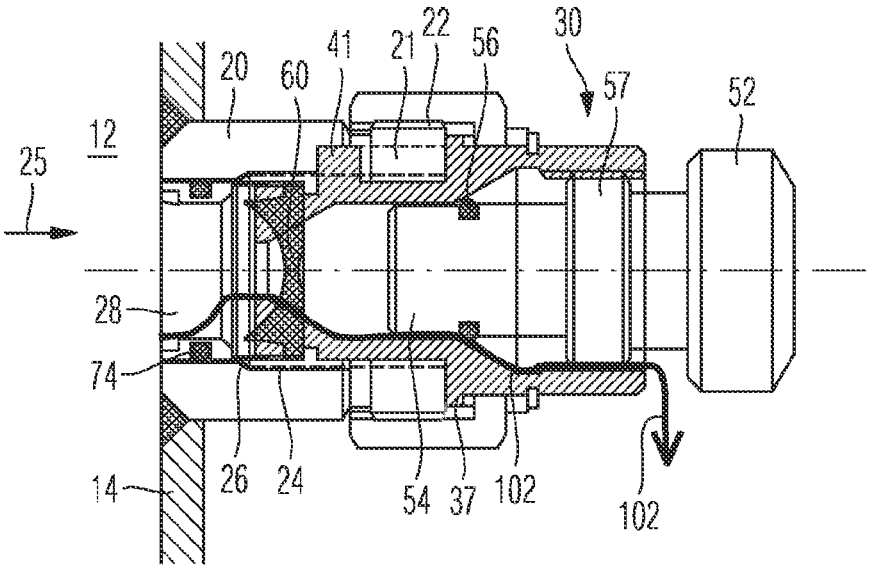
FIG. 4 shows the access assembly with the proximal closure member in leakage position and FIG. 5 shows the access assembly according to FIG. 4 with the proximal closure member in release position, FIG. 6*a* provides an isolated view of the distal closure member as seen from the interior of the vessel.

Between the proximally located inner thread 36 and the sealing portion 35, the insert 30 comprises a frusto-conical or tapered sidewall portion 34 which serves as a radially widening portion into which the sealing ring 56 is axially shifted when the proximal closure member 50 is axially displaced in proximal direction 2 to reach a leakage position as it is indicated in FIG. 4.

There, the sealing engagement between the sealing ring 56 and the sealing sidewall portion 35 is no longer maintained. In the event that the disc-shaped sealing member 60 is subject to malfunction, a streamlet 102 evolves by way of which a limited amount of the liquid medium may discharge through the non-sealing threaded interconnection of proximal closure member 50 and insert 30. The mutually corresponding threads 58, 36 are of non-sealing type so that the proximal closure member 50 can be kept securely fastened to the insert 30 while the streamlet 102 escapes through the threaded interconnection. Even in case that the septum or sealing member 60 is completely broken, the proximal closure member 50 may withstand a respective fluid pressure which may build up in the interior of the access assembly 20, hence, in its passageway 25.

The geometric shape and dimensions of the distal closure member 50 and the insert 30 are designed such, that a non-sealing but leaking configuration can be attained in which the proximal closure member 50 is still securely fastened to the insert 30.

Figure 5:
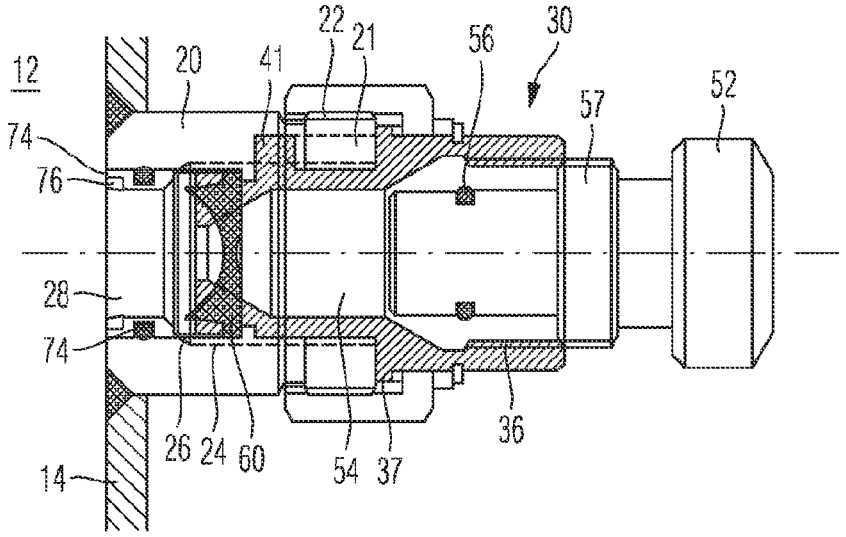

In the event that a streamlet 102 does not evolve when displacing the proximal closure member 50 into the leakage position as illustrated in FIG. 4, the closure member 50 may be unscrewed further to reach a release position as indicated in FIG. 5.

In this configuration, the proximal closure member 50 may be taken out of the insert 30 for providing free access to the pierceable sealing member 60 located at the distal end of the insert 30. Then, an operator may enter the insert 30 with a tipped piercing element, such like a cannula to penetrate or to puncture the pierceable sealing member 60 and to withdraw a sample from the liquid medium contained in the vessel 12. Here, the distally and radially inwardly tapered sidewall portions 34, 33 of the insert 30 also serve as a deflecting portion to guide the tipped piercing element and to prevent blunting thereof.

Since the exact radial location of the pierceable sealing member 60 may be difficult to determine, it may happen, that the tipped and free end of the piercing member may hit a sidewall portion of the insert 30 when manually inserted into the insert 30. By providing the sidewall portions 33, 34 with a radially inwardly tapered shape, the tipped piercing element may be guided and deflected in order to hit the radially centrally located pierceable sealing member 60 provided at the distal end face 32 of the insert 30.

Figure 8B:
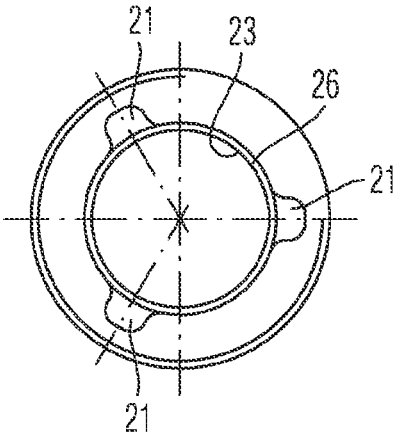
Figure 9:
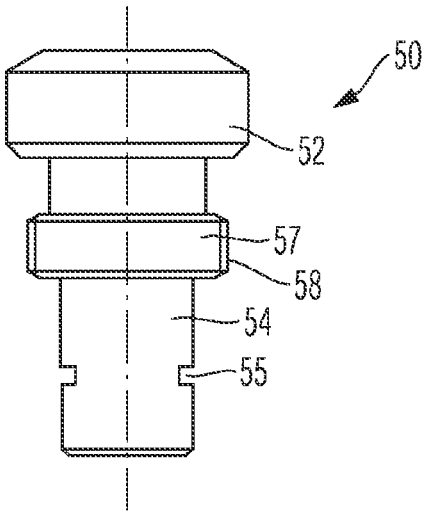

Furthermore and as indicated in FIGS. 10 and 8*b*, the insert 30 is rotatably locked to the base 20 by means of three radially outwardly extending projections 41 that engage with correspondingly-shaped and axially extending grooves 21 provided at the inside sidewall 23 of the proximal end of the base 20. Said grooves 21 extend radially outwardly from the inside sidewall 23 of the base 20. By means of mutually engaging or mutually mating projections 41 and grooves 21, the insert 30 is exclusively slidingly displaceable relative to the base 20 in distal and proximal direction 1, 2. By inhibiting a rotation of the insert 30 relative to the base 20, unintentional unscrewing of the distal closure member 70 from the distal end of the insert 30 while the distal closure member 70 is still constrained in the tubular sealing portion 28 of the base 20 can be effectively prevented.

The invention claimed is:

1. An access assembly to provide access to the interior of a vessel or a fluid guide comprising:

a base extending through a sidewall of the vessel and having a first tubular sealing portion defining a passageway axially extending therethrough, a pierceable sealing member arranged across the first tubular sealing portion to obstruct the passageway, at least one closure member axially displaceable relative to the base between a sealing position, in which the closure member completely obstructs and seals the passageway, and a leakage position, in which the closure member leakily obstructs the passageway and in which leakage position the closure member is securely fastened in the passageway, an insert axially slidingly displaceable in the base between a sealing position, a leakage position, and a release position, wherein the insert comprises a second tubular sealing portion, a proximal closure member sealingly engaging with the second tubular sealing portion, and a distal closure member sealingly engaging with the first tubular sealing portion.

2. The access assembly according to claim 1, wherein the closure member is axially displaceable from the sealing position via the leakage position into a release position, in which the closure member is detachable to provide access to the passageway.

3. The access assembly according to claim 1, wherein the closure member comprises an annular groove to receive a correspondingly shaped sealing ring.

4. The access assembly according to claim 1, wherein the insert is rotatably locked to the base by means of at least one radially extending projection engaged with an axially extending groove.

5. The access assembly according to claim 1, wherein the second tubular sealing portion engages with a sealing ring of the proximal closure member, when said closure member is in a sealing position relative to the insert.

6. The access assembly according to claim 5, wherein the insert comprises the radially widening portion axially adjacent to the sealing portion in a proximal direction, such that the sealing ring of the proximal closure member is received in the radially widened portion when the proximal closure member is in the leakage position.

7. The access assembly according to claim 5, wherein the proximal closure member is threadedly engaged with the insert in the sealing position as well as in the leakage position.

8. The access assembly according to claim 5, wherein the insert comprises a distally extending and radially inwardly tapering inside wall portion adjacent to the sealing portion.

9. The access assembly according to claim 5, wherein the insert comprises a radially outwardly extending flange at its outer circumference to engage with a radially inwardly extending flange of a fastening ring threadedly engageable with a proximal outer thread of the base.

10. The access assembly according to claim 1, wherein a distal closure member is slidingly displaceable in the sealing portion of the base, which the sealing portion extends into a radially widened portion in a proximal direction.

11. The access assembly according to claim 10, wherein the distal closure member comprises a proximally opened receptacle to receive the pierceable sealing member.

12. The access assembly according to claim 11, wherein the receptacle of the distal closure member is threadedly engageable with a distal end section of the insert.

13. The access assembly according to claim 10, wherein the distal closure member comprises an annular rim having at least two radially outwardly extending recesses on a distal end of an inside wall portion.

14. A vessel or a fluid guide to receive a liquid medium and further comprising at least one access assembly according to claim 1.

* * * * *